US005916331A

United States Patent [19]

Nagashima

[11] Patent Number: 5,916,331

[45] Date of Patent: Jun. 29, 1999

[54] HAND LEVER DEVICE

[75] Inventor: Akira Nagashima, Kanagawa, Japan

[73] Assignee: Kioritz Corporation, Tokyo, Japan

[21] Appl. No.: 08/905,952

[22] Filed: Aug. 5, 1997

[30] Foreign Application Priority Data

Aug. 6, 1996 [JP] Japan ..... 8-207173

[51] Int. Cl.[6] ..... G05G 1/08; G05G 1/04; G05G 5/06

[52] U.S. Cl. ..... 74/516; 74/506; 74/527; 74/528

[58] Field of Search ..... 74/516, 502, 506, 74/535, 527, 528; 254/121, 264

[56] References Cited

U.S. PATENT DOCUMENTS 4,876,914 10/1989 Kanno ..... 74/528
5,067,365 11/1991 Lauer .
5,477,746 12/1995 Perisho et al. ..... 74/516
5,575,178 11/1996 Wu ..... 74/506
5,758,546 6/1998 Taomo et al. ..... 74/506

*Primary Examiner*—Rodney H. Bonck
*Assistant Examiner*—Roger Pang
*Attorney, Agent, or Firm*—Cushman Darby Cushman; IP Group of Pillsbury; Madison & Sutro LLP

[57] ABSTRACT

A hand lever device is disclosed which enables a miniaturized compact hand lever device to be realized, which is capable of providing a hand lever device that is assembled with ease, which is capable of reducing amount of movement of a main lever to improve operability, and which enables fine adjustment of operation. The hand lever device (10) comprises: a main lever (30) for drawing a cable (17) connected to a driven member (CV), said main lever (30) being integrally provided with a draw amount magnifying mechanism (40) having a pulley (41) around which the cable (17) is reeved, said main lever (30) controlling the cable (17) via the pulley (41). The hand lever device (10) further comprises a turnaround member (45), and the turnaround member (45) guides the cable (17) from the pulley (41).

5 Claims, 5 Drawing Sheets

HAND LEVER DEVICE

BACKGROUND OF THE INVENTION

1. Field of the Invention

The present invention relates to a hand lever device. In particular, the hand lever device is preferably mounted on a working machine, such as a hedge trimmer or brush cutter, in the vicinity of a hand grip so that it is easy and convenient to operate a driven member such as a throttle valve of an internal combustion engine via a cable.

2. Description of the Related Art

In general, in a conventional working machine, such as a hedge trimmer and brush cutter, which comprises an operative portion including a cutting blade or the like driven by an internal combustion engine, a hand lever device is provided for controlling the degree of opening of a throttle valve of the internal combustion engine. Such a hand lever is mounted in the vicinity of a grip of a U-shaped handle, a bar handle, or the like of the working machine to provide manual control of the throttle valve of the internal combustion engine or the like.

The hand lever device is generally provided with a throttle lever operated by operator's fingers with the throttle lever being pivotally operated to thereby control the degree of opening of the throttle valve via a throttle cable. In general, the throttle valve is always biased toward the direction of minimum valve opening that allows the engine to idle. Accordingly, the throttle valve is normally kept at the idle opening position and, when the throttle cable is drawn in a predetermined amount to eliminate play, it begins to open from the opening position for idling (slow running) of the engine toward an opening position for operation (higher speed running) of the engine.

Examples of such known hand lever devices for controlling throttle valve settings include a type wherein when such a throttle lever is released from a pivotally operated position, the lever is automatically returned to its original idle position setting, thereby automatically moving the throttle valve to its idle setting; and a type where, even if fingers are released from a throttle lever, the throttle lever is held at a desired pivotally operated position.

In both types, when the throttle lever which has once been released to suspend operation is returned to the previous opening degree to resume operation, the pivotally operated position of the throttle lever must be readjusted. In view of such cumbersome operation, there are problems in operability.

To solve the above problems, a hand lever in which the throttle valve can be adjusted appropriately in its opening degree via a cable, kept at a desired opening degree, and yet immediately returned to the minimum opening degree (the opening degree for idle running), and the throttle valve can be brought to the opening degree at which it had stood before it was returned to the minimum opening degree without necessity of readjustment is proposed in Japanese Patent Application No.108340/1995.

The proposed hand lever device comprises a main lever and a sub-lever which are pivotally operated. The sub-lever is adapted to draw a cable connected to a throttle valve via a pulley, and the main lever acts as a link of a toggle mechanism. By pivotally operating the main lever, the pulley is moved which is pivotally held by a slider of the toggle mechanism.

In the hand lever device constructed as described above, when the main lever is operated to pivot to a position close to a grip of a handle, the throttle cable is drawn via the pulley in a predetermined amount to eliminate play, thereby bringing the throttle valve to the minimum opening degree (the opening degree for idle running). Then, the sub-lever is pivotally operated with the main lever held at the above-mentioned position. The throttle cable is thereby further drawn via the pulley. This means that the throttle valve is adjusted in its opening degree from the minimum opening degree to a intended opening degree. By the adjustment of the opening degree, an internal combustion engine is actuated at a desired rotational speed.

In this condition, even if the operator's hold on the sub-lever is released, the sub-lever is kept at the pivotally operated position by frictional force or the like, and the throttle valve is thus kept at the adjusted opening degree.

When the main lever is released from the above condition, the throttle cable is returned to the non-operating position to return the throttle valve to the opening degree for idle rotation because the throttle cable is biased toward the throttle valve closing direction. As a result the engine idles.

In the proposed hand lever device, the toggle mechanism is used to relieve stress exerted on the fingers when the main lever is at the set position close to the grip of the handle, and the pulley is used to magnify the amount of movement of the throttle cable. However, the hand lever device constructed as described above is rather large in size as a whole, and accordingly, the demand for size reduction is not yet sufficiently satisfied. Further, it has a room for improvement in assembling properties.

Moreover, the amount of movement of the throttle cable is magnified by the use of the pulley. However, the amount of pivotal movement of the main lever is still large. Accordingly, there is a problem in operability of the lever and there is still room for improvement in operability.

Furthermore, the sub-lever is kept at its pivotally operated position by frictional force or the like. However, frictional force has problems in that the position tends to be accidentally shifted, and that the pivotally operated position cannot be determined precisely.

SUMMARY OF THE INVENTION

The present invention has been made in view of these problems. It is, therefore, an object of the present invention to provide a miniaturized compact hand lever device which is easily assembled, improves operability by reducing the amount of movement of a main lever, and enables fine adjustment of operation.

To achieve the above objective, the hand lever device according to the present invention includes:

a main lever for drawing a cable connected to a driven member to control position of the cable, wherein the main lever is integrally provided with a draw amount magnifying mechanism having a pulley around which the cable is reeved, and the main lever controlling the cable via the pulley. The hand lever device preferably comprises a turnaround member, and the turnaround member guides the cable from the pulley.

In a preferred embodiment, the turnaround member is provided with a position adjusting mechanism having a sub-lever which moves the turnaround member and keeps it at an intended position. It is preferred that the turnaround member be a pulley.

Further, it is preferred that the position adjusting mechanism include a push button having a movable serrated portion which releasably holds the sub-lever in an intended position, a bottom-closed sleeve biased in the push button by a spring, and a stationary serrated portion formed on a case of the hand lever device which meshes with the movable serrated portion.

In the hand lever device according to the present invention which is constructed as described above, the cable is controlled by the main lever in the presence of two pulleys. Accordingly, the amount of drawing (amount of displacement) of the cable is magnified relative to the amount of movement of the pulley integral with the main lever.

In other words, the throttle cable is reeved around the pulley of the draw amount magnifying mechanism and consequently turned around, and then reeved around the movable pulley of the position adjusting mechanism and thereby again turned around, and has its front end anchored to the draw amount magnifying mechanism. Accordingly, when the draw amount magnifying mechanism is moved by pivotally operating the main lever, the throttle cable is drawn in an amount about 3 times the amount of the movement of the draw amount magnifying mechanism.

In short, the throttle cable is drawn in a magnified amount relative to the amount of the movement of the draw amount magnifying mechanism based on angular amount of the pivotal operation of the main lever. Accordingly, the angular amount of the pivotal operation of the main lever can be smaller as compared with those of conventional devices. By virtue of this, a space for pivotal operation of the main lever can be minimized which is provided between the grip of the handle and the main lever. This enables a small-sized and light weight hand lever device to be realized and leads to improved operability.

Thereafter, when the push button of the position adjusting mechanism is pressed to move the sub-lever to a desired position, the movable pulley is caused to move to the throttle cable drawing direction. Consequently, the throttle cable is further drawn via the draw amount magnifying mechanism, and the throttle valve is brought from the minimum opening degree (the opening degree for idle running) toward a more opening degree, thereby achieving appropriate control of opening degree of the throttle valve. It is to be noted that the throttle cable is drawn by the movable pulley with the cable reeved around the movable pulley, and accordingly, it is drawn in an amount two times the amount of the movement of the movable pulley. Accordingly, the amount of operation (the amount of movement) of the sub-lever of the position adjusting mechanism can be reduced. By virtue also of this, a reduced size and light weight device is realized.

It is further to be noted that even if the push button of the sub-lever is released from the pressing force, the sub-lever is held at the operated position by the engagement between the movable serrated portion and the stationary serrated portion, thereby keeping the throttle valve at the adjusted opening degree (set opening degree).

Under such condition as described above in which the opening degree of the throttle valve is adjusted, in the event that it is necessary to immediately lower the speed of the engine due to occurrence of accident or the like, the main lever is released. Because the throttle cable is always biased toward the direction of minimum valve opening of the throttle valve, the throttle cable is returned to the non-operating condition and the throttle valve is returned to the above-mentioned opening degree for idling. The engine is thereby brought into its idle condition.

In the working machine adapted so that rotational driving force of the engine is transmitted to the operative portion including cutting blade and so forth via a centrifugal clutch, rotational speed of the engine becomes low to bring centrifugal clutch into disconnective condition. In consequence, the transmission of the driving force to the operative portion is cut off, thereby immediately stopping the operation of the operative portion including the cutting blade and so forth.

However, when the main lever is again pivotally operated to move to the set position after having been once released, the play of the throttle cable is eliminated with the sub-lever is still immobilized at the previous operated position. Consequently, the throttle valve is returned to the opening degree at which it had stood before the main lever was released, without necessity of readjusting the sub-lever.

DETAILED DESCRIPTION OF THE INVENTION

In the following, an embodiment of the hand lever device of the present invention will be described with reference to the accompanying drawings.

Figure 1:
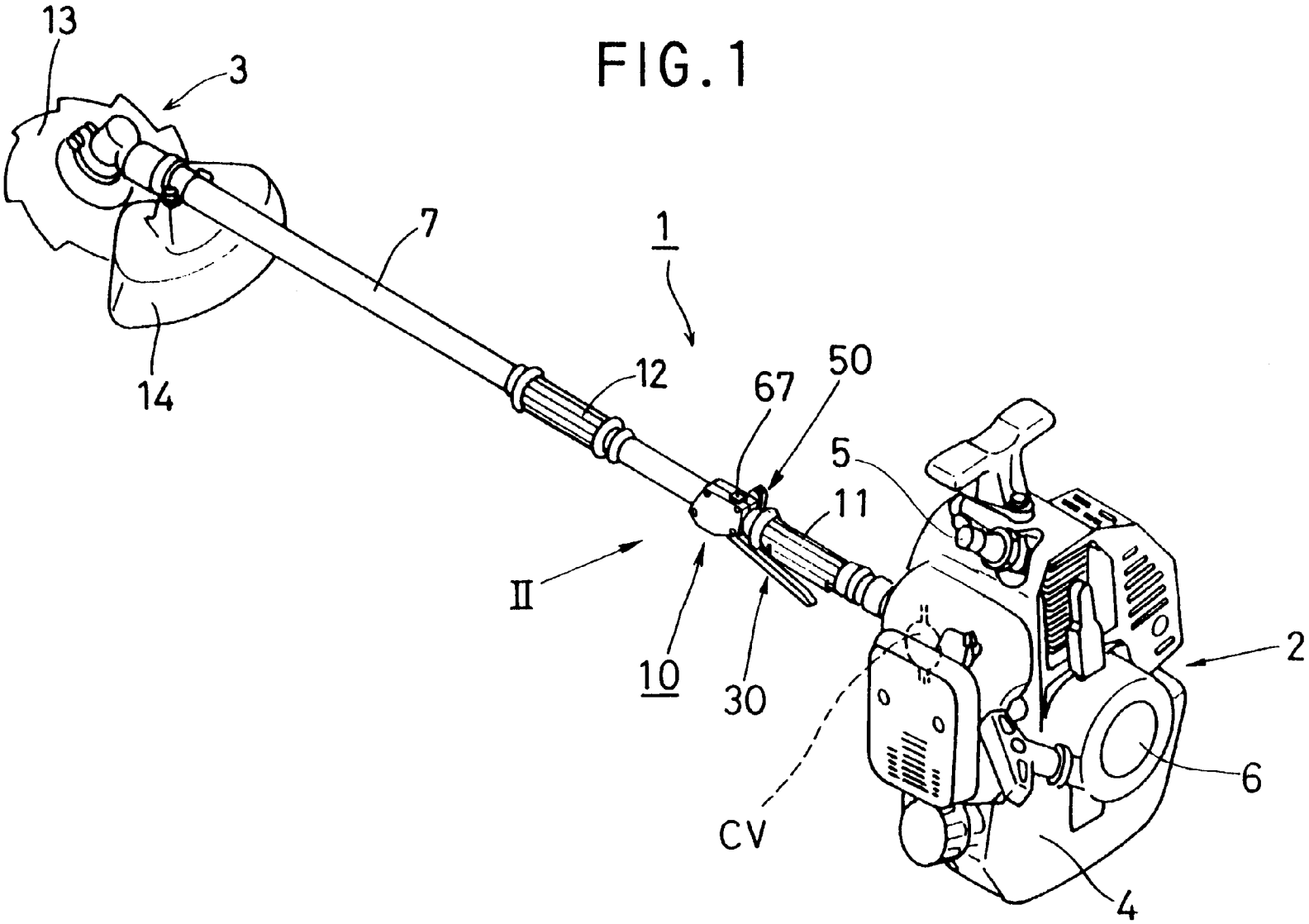
FIG. 1 is a perspective view showing a brush cutter using one embodiment of the hand lever device according to the present invention.

FIG. 1 shows an example of a brush cutter using the hand lever device according to an embodiment of the present invention. The brush cutter 1 comprises a bar handle (operating rod) 7 provided with grips 11, 12 spaced a predetermined distance apart, and an operative portion 3 provided on the distal end of the bar handle 7. The operative portion 3 includes a cutting blade 13, and a safety cover 14. The brush cutter 1 also includes an internal combustion engine 2, for example, a small air-cooled two-cycle gasoline engine, which is disposed on the proximal end of the bar handle 7. The engine 2 provides driving power for driving the cutting blade 13 via a drive shaft 8 extending through and within the bar handle 7. The internal combustion engine 2 is equipped with a recoil starter 6 and a fuel tank 4 and is also provided with a carburetor having a throttle valve CV and a spark plug 5.

In this example, the throttle valve CV is always biased in the direction of a minimum degree of opening (for an idle condition). When a throttle cable 17 connected with the throttle valve CV, which will be described below, is ruled in from non-operating position a predetermined amount to eliminate play, the throttle valve CV begins to open from the minimum idle opening position.

The hand lever device 10 is provided in the vicinity of the grip 11, which is one of the grips 11, 12 that is gripped generally by an operator's right hand. The hand lever 10 is used to adjust the degree of opening of the throttle valve CV.

Figure 2:
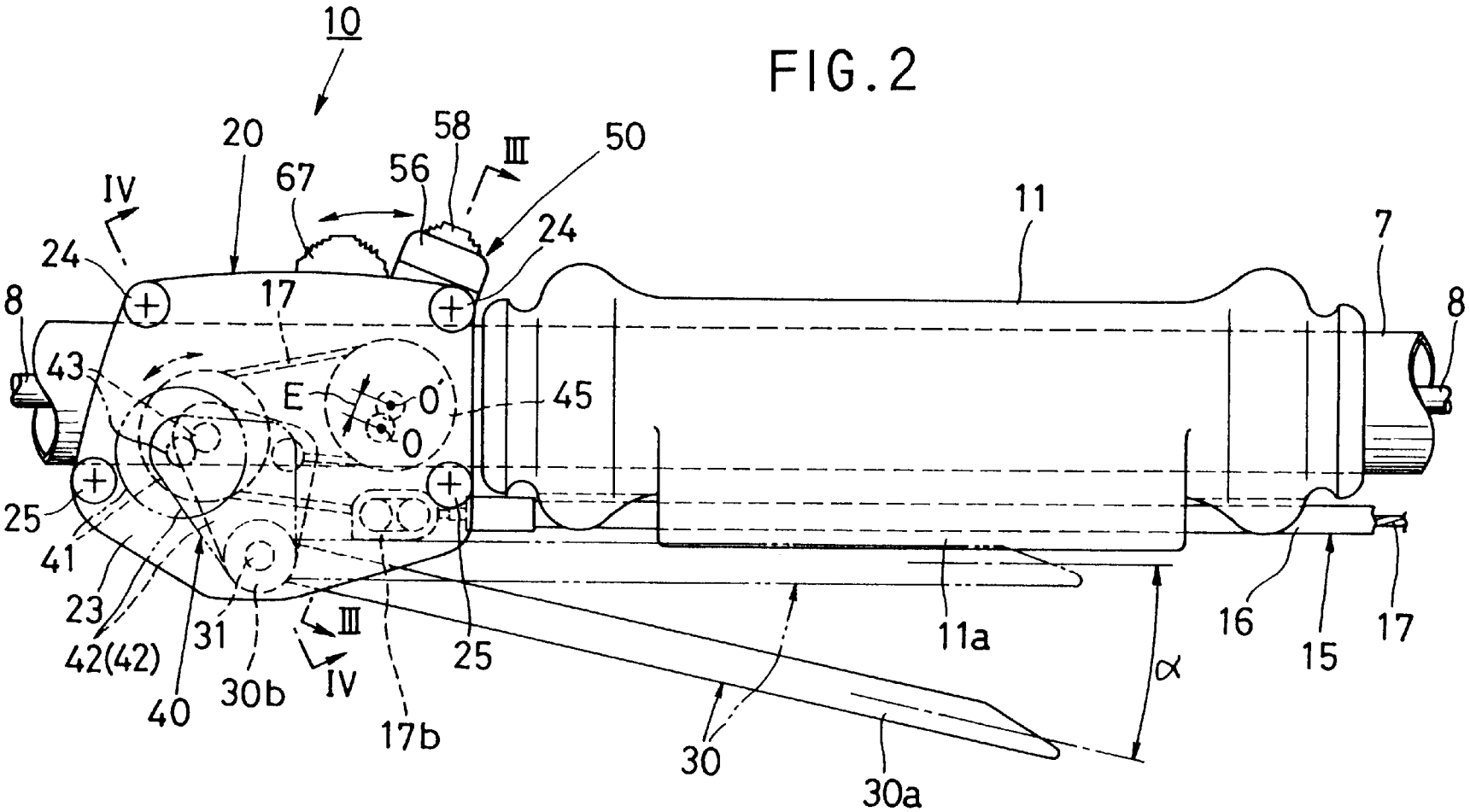
FIG. 2 is a left side view of the hand lever device in FIG. 1 viewed from the direction of the arrow II.
Figure 3:
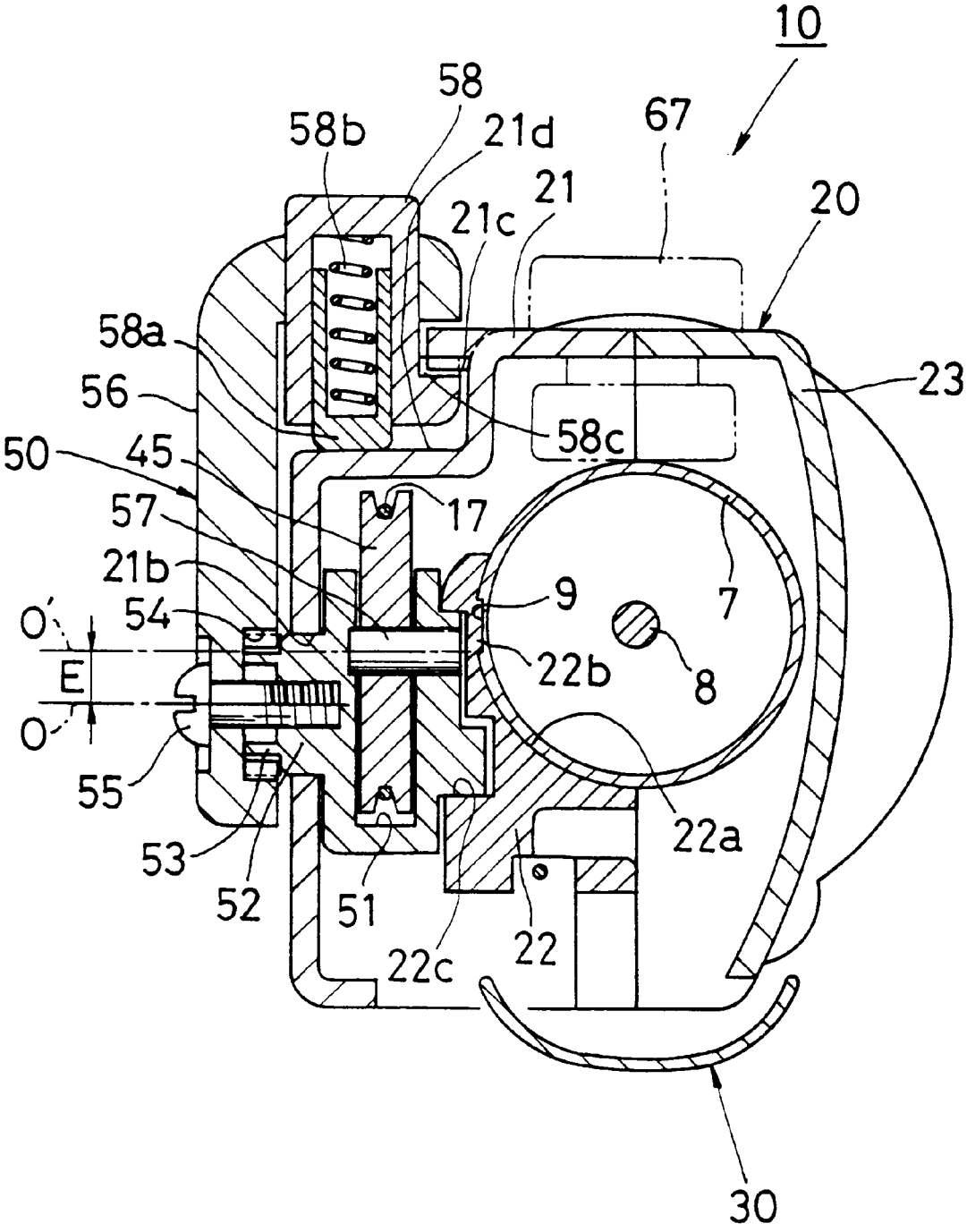
FIG. 3 is a sectional view taken along the line III—III and viewed in the direction of arrows in FIG. 2.
Figure 4:
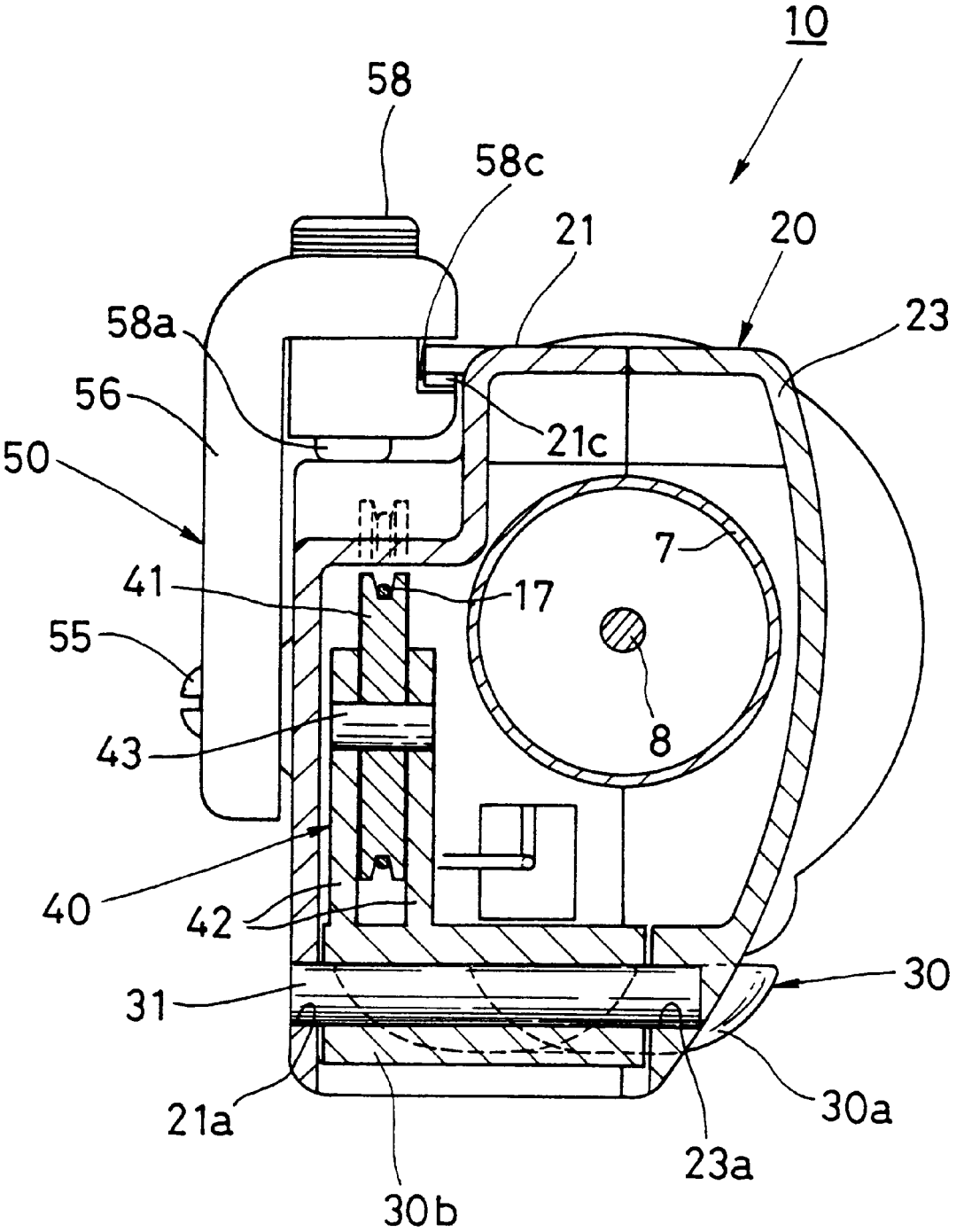
FIG. 4 is a sectional view taken along the line IV—IV and viewed in the direction of arrows in FIG. 2.
Figure 5:
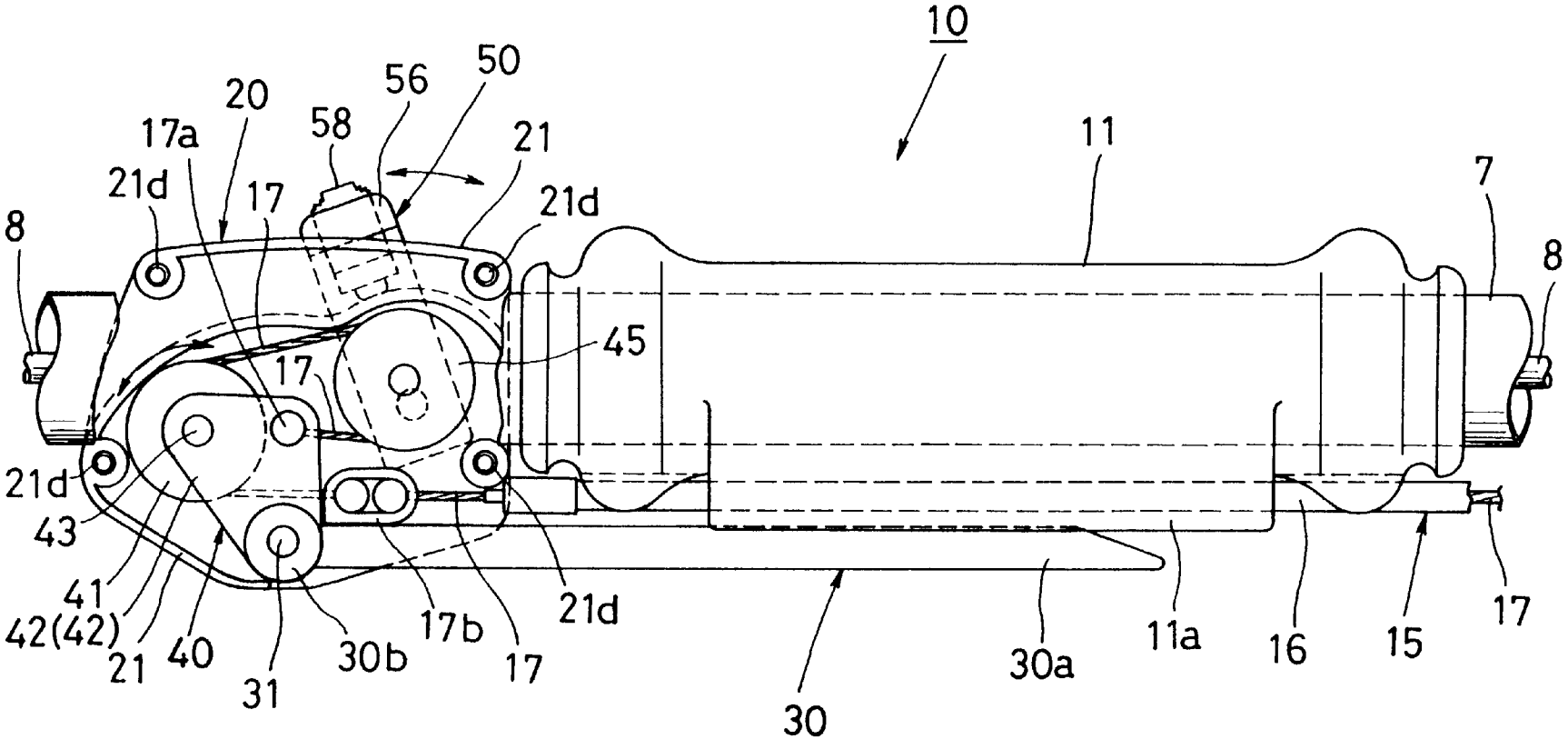
FIG. 5 is a partially broken side view wherein a left case member of the hand lever device in FIG. 2 is removed.

FIG. 2 is an external view of the hand lever device 10, FIGS. 3 and 4 are sectional views of the hand lever device 10 shown in FIG. 2, and FIG. 5 is a side view of the hand lever device 10 shown in FIG. 2 wherein a left case member 23 is removed.

As shown in FIG. 2, the hand lever device 10 has a case 20 fixedly mounted on the handle 7 in the vicinity of the proximal grip 11. In the case 20, a main lever 30 has its one end pivotally held for drawing the throttle cable 17 extending through and within an outer tube 16 of a Bowden cable 15 connected with the throttle valve CV.

The case 20 has a ternary structure composed of a right case member 21, an intermediate case member 22, and a left case member 23, which are made of a synthetic resin, as understood from FIG. 3.

Each of the right and left case members 21, 23 has a substantially rectangular tray-like appearance. The right and left case members 21, 23 are fixedly fitted over the handle 7 with the intermediate case member 22 interposed therebetween and with semi-circular abutting portions (not shown), which are formed at the front and rear ends thereof, abutting upon the circumferential surface of the handle 7 to hold the handle 7 therebetween.

The intermediate case member 22 is placed in the right case member 21 in contact with the inner wall surface (not shown) of the right case member 21 and has an abutting wall portion 22*a* which has a semi-circular section for abutting on a lower right portion of the circumferential surface of the handle 7. The abutting wall portion 22*a* is fitted on the circumferential surface of the handle 7 so that a protrusion 22*b* formed on the abutting wall portion 22*a* is fitted in a recess 9 in the form of a circular blind hole formed on the circumferential surface of the handle 7.

The right case member 21, the left case member 23, and the intermediate case member 22 disposed in the right and left case members 21, 23 are tightened together by case tightening screws 24, 25 which are screwed from the side of the left case member 23 into threaded holes 21*d*. By tightening the case members together, the hand lever device 10 is fixedly mounted on the handle 7.

The main lever 30 pivotally held by the case 20 comprises an operating portion 30*a* pivotally operated by fingers so that it is brought closer to a lever rest 11*a* formed at the bottom of the proximal grip 11, and a cylindrical portion 30*b* loosely fitted on a lever supporting pivot pin 31. The right end of the lever supporting pivot pin 31 is press-fit through an insertion hole 21*a* formed near the rear bottom corner of the right case member 21, and the left end of the lever supporting pivot pin 31 is press-fit in an insertion hole 23*a* formed in the left case member 23.

A draw amount magnifying mechanism 40 is integrally provided on the cylindrical portion 30*b* of the main lever 30. The draw amount magnifying mechanism 40 includes a pulley 41 and right and left supporting plates 42 for supporting the pulley 41. Each supporting plate 42 is substantially triangular and formed integrally with the cylindrical portion 30*b* at one corner so that these two supporting plates 42 are spaced a predetermined distance apart. Between two others corners of the supporting plates 42, the pulley 41 is rotatably mounted by a pulley supporting pin 43. Between set two other corners of the supporting plates 42, a front end 17*a* of the throttle cable 17 is anchored.

In the illustrated embodiment, for easy assembly and disassembly, portions of the cable 17 are joined by means of a joint 17*b* in the case 20.

When the main lever 30 is pivotally operated, the draw amount magnifying mechanism 40 is swung to move the throttle cable 17 in forward or backward.

In this embodiment, a movable pulley 45 is provided in the case 20. The throttle cable 17, extending from the throttle valve CV, is reeved around the pulley 41 of the draw amount magnifying mechanism 40 from the lower side and consequently turned around backwardly, and then reeved around the movable pulley 45 from the upper side and thereby led forwardly, and has its front end anchored between the third pair of corners of the supporting plates 42 of the draw amount magnifying mechanism 40. Accordingly, when the main lever 30 is pivotally operated to swing the draw amount magnifying mechanism 40, the throttle cable 17 is moved forward or backward via the two pulleys 41, 45.

The movable pulley 45 is provided with a position adjusting mechanism 50 for moving the movable pulley 45 in the forward or backward direction. The position adjusting mechanism 50 keeps the movable pulley 45 at an adjusted position to hold the throttle cable 17 at an intended position. The position adjusting mechanism 50 includes a pivot pin 52 and a sub-lever 56. The pivot pin 52 has a serrated pin portion 53 at its right end and a cover 51 for containing the movable pulley 45. The sub-lever 56 has a serrated portion 54 in mesh with a serrated pin portion 53 and is fixedly attached to the right end of the pivot pin 52 by a screw 55. The left end of the pivot pin 52 is supported by a pin receiving portion 22*c* formed in the right side of the intermediate case member 22, and the left end of the pivot pin 52 is supported by a pin receiving portion 21*b* formed in the right case member 21. In the cover 51, the movable pulley 45 is pivotally supported by a pulley supporting pin 57. The pulley supporting pin 57 supporting the movable pulley 45 is eccentrically located relative to the pivot pin 52 of the sub-lever 56 so that the axis O' of the pulley supporting pin 57 is upwardly spaced a distance E apart from the pivotal axis O of the sub-lever 56 (the axis of the pivot pin 52). When the sub-lever 56 is pivoted backward, as shown in FIG. 2, the movable pulley 45 is moved in the throttle cable drawing direction (backward direction).

Into the top of the sub-lever 56, a top-closed (bottomless) tubular push button 58 is vertically slidably inserted. In the push button 58, a bottom-closed sleeve 58*a*, which is always downwardly biased by a coil spring 58*b*, is fitted. The push button 58 is mounted slidably back and forth with the bottom of the sleeve 58*a* caused to abut upon an upper right shoulder of the right case member 21. On a left side of the lower end of the push button 58, a movable serrated portion 58*c* with serrations that protrude upwardly. On the other hand, in an upper portion of the right case member 21, a stationary serrated portion 21*c* is provided whose serrations protrude downwardly and extend in the longitudinal direction along an arc having its center on the pivotal axis O of the sub-lever 56, and with which the movable serrated portion 58*c* is engaged.

In the position adjusting mechanism 50 of the movable pulley 45, when the push button 58 is pressed downwardly, the movable serrated portion 58*c* and the stationary serrated portion 21*c* are disengaged from each other. Under this condition, when the push button 58 is moved backwards to a desired position, the sub-lever 56 swings backward. As a result, the movable pulley 45 is moved in the throttle cable drawing direction (backward direction). Then, the push button 58 is released from the pressing force. The movable serrated portion 58*c* and the stationary serrated portion 21*c* are thereby brought into engagement again. Consequently, the sub-lever 56 and the movable pulley 45 are kept at the pivotally operated position.

A slide type cut-off switch 67 is provided in the top of the case 20 which is formed by the right and left case members 21, 23, for short-circuiting an electrical circuit to the spark plug 5 of the internal combustion engine 2 to stop the engine 2.

In the following, operation of the hand lever device 10 of this embodiment constructed as described above is explained.

In the hand lever device 10 of this embodiment, when the recoil starter 6 is operated with the sub-lever 56 at the foremost position (proximate to the operative portion 3), the internal combustion engine 2 is started. In this condition, however, the internal combustion engine 2 is idling, and thus, the rotational speed is so low that a centrifugal clutch is still disconnected. Consequently, the cutting blade 13 of the operative portion 3 does not rotated.

In this condition, when the main lever 30 of the hand lever device 10 is pivotally operated to the set position closer to the lever rest 11*a* of the proximal grip 11 of the handle 7, the draw amount magnifying mechanism 40 is swung forward, and the pulley 41 of the draw amount magnifying mechanism 40 is moved forwardly. By the movement, the throttle cable 17 is drawn in a predetermined amount via the pulley 41 and the movable pulley 45 to eliminate play.

It is to be noted that the amount of drawing (amount of displacement) of the throttle cable 17 by the main lever 30 is magnified according to the amount of the movement of the pulley 41. The throttle cable 17 is reeved around the pulley 41 and consequently turned around backwardly, and then reeved around the movable pulley 45 and thereby again turned around forwardly, and has its front end 17*a* anchored between the right and left supporting plates 42 of the draw amount magnifying mechanism 40. Accordingly, when the pulley 41 of the draw amount magnifying mechanism 40 is moved forward, the throttle cable 17 is moved via the pulley 41 and the movable pulley 45 in an amount according to the amount of the movement of the draw amount magnifying mechanism 40. In other words, the throttle cable 17 is drawn in an amount about three times the amount of the forward movement of the pulley 41 of the draw amount magnifying mechanism 40. In short, the throttle cable 17 is drawn in a magnified amount relative to the amount of the movement of the draw amount magnifying mechanism 40 based on angular amount $\alpha$ of the pivotal operation of the main lever 30. Accordingly, the required angular amount $\alpha$ of the pivotal operation of the main lever 30 can be smaller as compared with those of conventional devices. By virtue of this, the space for pivotal operation of the main lever can be minimized which is provided between the proximal grip 11 of the handle 7 and the main lever 30. This enables a small-sized and light weight hand lever device 10 to be realized and leads to improved operability.

Thereafter, when the push button 58 of the position adjusting mechanism 50 is pressed to move the sub-lever 56 to a backward desired position with the main lever 30 kept at the set position (the position shown in FIG. 5), the movable pulley 45 moves in the throttle cable drawing direction (backward direction). Consequently, the throttle cable 17 is drawn in via the draw amount magnifying mechanism 40 and the movable pulley 45, and the throttle valve CV is brought from the minimum opening degree (the opening degree for idling) to a large opening degree, thereby achieving appropriate control of opening degree of the throttle valve CV.

It is to be noted that the throttle cable 17 is drawn in by the movable pulley 45 with the cable 17 reeved around the movable pulley 45, and accordingly, it is drawn in an amount two times the amount of the movement of the movable pulley 45. Accordingly, the amount of operation of the sub-lever 56 of the position adjusting mechanism 50, in other words, the amount of the movement of the movable pulley 45 can be reduced which is necessary to appropriately adjust the opening degree of the throttle valve CV. By virtue also of this, a reduced size and light weight device is realized.

It is further to be noted that even if the push button 58 of the sub-lever 56 is released from the pressing force, the sub-lever 56 is held immobilized at the operated position by the engagement between the movable serrated portion 58*c* and the stationary serrated portion 21*c*, thereby keeping the throttle valve CV at the adjusted opening degree (set opening degree). Accordingly, stress on the fingers during operation is relieved.

Under such condition as described above in which the opening degree of the throttle valve CV is adjusted, in the event that it is necessary to immediately lower the speed of the engine 2 due to the occurrence of accident or the like, the main lever 30 is released (the condition shown by the solid line in FIG. 2). In this case, the main lever 30 and the pulley 41 of the draw amount magnifying mechanism 40 move in the opposite direction, i.e., toward the backward direction and returned to the original positions, because the throttle cable 17 is always biased in the direction of minimum valve opening of the throttle cable CV. As a result, the throttle cable 17 is returned to the non-operating condition and the throttle valve CV is returned to the above-mentioned opening degree for idling. The engine 2 is thereby brought into its idle condition.

In the working machine 1 adapted so that the rotational driving force of the engine 2 is transmitted to the operative portion 3 including cutting blade 13 and so forth via a centrifugal clutch, rotational speed of the engine 2 becomes low to bring centrifugal clutch into disconnective condition. In consequence, the transmission of the driving force to the operative portion is cut off, thereby immediately stopping the operation of the operative portion 3 including the cutting blade 13 and so forth.

When the main lever 30 is again pivotally operated to move to the set position closer to the lever rest 11*a* of the proximal grip 11 of the handle 7 after having been once released, the play of the throttle cable 17 is eliminated with the sub-lever 56 of the position adjusting mechanism 50 is still immobilized at the previous operated position. Consequently, the throttle valve CV is returned to the opening degree where it was before the main lever 30 was released, without the necessity of readjusting the sub-lever 56.

As described above, in the hand lever device 10 of this embodiment, the opening degree of the throttle valve CV as a driven member is adjusted via the cable 17, and the throttle valve CV can be kept at a desired opening degree and can also immediately be returned to the minimum opening degree (opening degree for idling). This ensures high safety and reduces fatigue of fingers. Further, when it is intended that the throttle valve CV should be set to the opening degree at which it had stood before the throttle valve CV was returned to the opening degree for idling, readjusting is not required. Moreover, realization of a reduced size and light weight device is effectively achieved and improved operability is obtained.

The present invention has been described in detail with reference to one embodiment. It is, however, to be understood that the present invention is by no means restricted to the above-described embodiment, and that various modifications may be made within the scope which do not depart from the spirit of the present invention as defined in the claims.

For example, in the described embodiment, the hand lever device 10 is used to control opening degree of the throttle valve CV of the internal combustion engine 2. It is, however, to be understood that the hand lever device of the present invention may, of course, be used in other applications than adjustment of opening degree of the throttle valve CV.

Further, the hand lever device 10 as such may be used by mounting it on a U-shaped handle and the like other than the bar handle 7.

As understood from the above description, the hand lever device of the present invention is so constructed that when the amount of the movement of the driven member such as a throttle valve is adjusted via the cable, the cable is operated by the main lever in the presence of the movable pulley. Accordingly, if the main lever is pivotally operated even in a small amount, sufficient change in opening degree of the throttle valve can be obtained. This enables a small-sized and light weight hand lever device to be realized and leads to improved operability.

Further, by providing the sub-lever immobilizable at an adjusted position, a hand lever device can be provided which is capable of easily keeping the throttle valve or the like at a desired opening degree and immediately returning it to the minimum opening position (for idling).

What is claimed is:

1. A hand lever device, said hand lever device comprising:

a main lever for drawing a cable connected with a driven member, said main lever being integrally provided with a draw amount magnifying mechanism having a pulley around which said cable is reeved, said main lever controlling said cable via said pulley; and a turnaround member that guides said cable from said pulley, where said cable has a front end anchored to said draw amount magnifying mechanism.

2. The hand lever device as claimed in claim 1, wherein said turnaround member is provided with a position adjusting mechanism having a sub-lever which moves said turnaround member and keeps said turnaround member at an intended position.

3. The hand lever device as claimed in claim 1 or 2, wherein said turnaround member is a second pulley.

4. The hand lever device as claimed in claim 2, wherein said position adjusting mechanism comprises a push button having a movable serrated portion which releasably holds said sub-lever at said intended position, a bottom-closed sleeve biased in said push button by a spring, and a stationary serrated portion separately formed on said hand lever device which meshes with said movable serrated portion.

5. The hand lever device as claimed in claim 1, wherein said turnaround member is provided with a position adjusting mechanism having a sub-lever and said position adjusting mechanism comprises a push button having a movable serrated portion which releasably holds said sub-lever at said intended position, a bottom-closed sleeve biased in said push button by a spring, and a stationary serrated portion separately formed on said hand lever device which interacts with said movable serrated portion.

* * * * *